US008734129B2

(12) United States Patent
Schiffhauer et al.

(10) Patent No.: US 8,734,129 B2
(45) Date of Patent: May 27, 2014

(54) MOTOR PUMP UNIT

(75) Inventors: Walter Schiffhauer, Leutenbach (DE); Dieter Plachke, Winnenden (DE); Lanfranco Pol, Quistello Mn (IT)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 4 days.

(21) Appl. No.: 13/197,889

(22) Filed: Aug. 4, 2011

(65) Prior Publication Data

US 2012/0034112 A1 Feb. 9, 2012

Related U.S. Application Data

(63) Continuation of application No. PCT/EP2009/001027, filed on Feb. 13, 2009.

(51) Int. Cl.
*F04B 39/06* (2006.01)
*H02K 9/00* (2006.01)

(52) U.S. Cl.
USPC ..... 417/371; 417/366; 310/62

(58) Field of Classification Search
USPC ..... 417/371, 366, 368; 310/52, 54, 62
See application file for complete search history.

(56) References Cited

U.S. PATENT DOCUMENTS 1,431,907 A * 10/1922 Cramer ..... 417/371
1,614,091 A * 1/1927 Van Toff ..... 417/371
2,037,245 A 4/1936 Leifheit et al.
2,301,063 A 11/1942 McConaghy
2,734,459 A 2/1956 Zimsky
2,763,214 A * 9/1956 White ..... 417/357
2,782,720 A 2/1957 Dochterman
2,854,595 A * 9/1958 Arutunoff ..... 310/87
2,913,988 A * 11/1959 White ..... 417/357
2,914,253 A 11/1959 Jobus et al.
2,993,449 A * 7/1961 Harland ..... 417/357

(Continued)

FOREIGN PATENT DOCUMENTS

DE 926 676 4/1955
DE 27 16 184 10/1977

(Continued)

OTHER PUBLICATIONS

Patent Abstracts of Japan, Abstract of Japanese Patent "Scroll-Type Fluid Machine", Publication No. 61250393, Nov. 7, 1986, Japanese Application No. 60091533, Filed Apr. 26, 1985.

(Continued)

*Primary Examiner* — Charles Freay
*Assistant Examiner* — Alexander Comley
(74) *Attorney, Agent, or Firm* — Lipsitz & McAllister, LLC

(57) ABSTRACT

A motor pump unit for a high-pressure cleaning apparatus has an electric motor and a pump. The electric motor has a motor housing that is surrounded by a cooling housing with an annular space having an annular space inlet and an annular space outlet formed therebetween. The pump has a suction inlet connected to the annular space outlet and a pressure outlet. The liquid to be transported by the pump can be supplied to the annular space inlet. The cooling housing, on its inside, has at least one flow guide rib for guiding the liquid within the annular space. In order to ensure that no liquid can leak out of the annular space even in the long term, the at least one flow guide rib is spaced-apart from the motor housing.

8 Claims, 3 Drawing Sheets

(56) References Cited

U.S. PATENT DOCUMENTS

| | | | | | |
|---|---|---|---|---|---|
| 3,135,213 | A | * | 6/1964 | Smith et al. | 417/368 |
| 3,371,613 | A | * | 3/1968 | Dahlgren et al. | 417/368 |
| 3,426,691 | A | | 2/1969 | Anderson | |
| 3,525,001 | A | * | 8/1970 | Erickson | 310/54 |
| 3,667,870 | A | * | 6/1972 | Yoshida et al. | 417/357 |
| 3,738,781 | A | * | 6/1973 | Hagemann et al. | 417/423.11 |
| 3,744,935 | A | | 7/1973 | Magni | |
| 3,992,133 | A | * | 11/1976 | Brunner | 417/366 |
| 4,480,967 | A | * | 11/1984 | Schulze | 417/368 |
| 4,516,044 | A | | 5/1985 | Bone | |
| 4,648,809 | A | * | 3/1987 | Gensberger | 417/366 |
| 4,700,092 | A | * | 10/1987 | Bincoletto | 310/54 |
| 4,808,087 | A | * | 2/1989 | Tsutsui et al. | 417/369 |
| 4,844,701 | A | | 7/1989 | Wolford et al. | |
| 4,878,804 | A | * | 11/1989 | Akerman et al. | 415/111 |
| 4,922,148 | A | | 5/1990 | Kitamura | |
| 4,934,914 | A | * | 6/1990 | Kobayashi et al. | 417/423.3 |
| 4,958,988 | A | * | 9/1990 | Regev | 417/53 |
| 5,040,950 | A | * | 8/1991 | Dalquist et al. | 417/234 |
| 5,113,103 | A | * | 5/1992 | Blum et al. | 310/89 |
| 5,145,335 | A | | 9/1992 | Abelen et al. | |
| 5,174,730 | A | | 12/1992 | Nieuwkamp et al. | |
| 5,240,391 | A | | 8/1993 | Ramshankar et al. | |
| 5,250,863 | A | * | 10/1993 | Brandt | 310/54 |
| 5,283,915 | A | | 2/1994 | Idland et al. | |
| 5,326,235 | A | * | 7/1994 | Bruhn | 417/410.1 |
| 5,349,147 | A | | 9/1994 | Gallone | |
| 5,350,281 | A | * | 9/1994 | Hagshenas | 417/371 |
| 5,354,182 | A | * | 10/1994 | Niemiec et al. | 417/363 |
| 5,363,674 | A | * | 11/1994 | Powell | 62/505 |
| 5,388,970 | A | | 2/1995 | Muckelmann et al. | |
| 5,395,214 | A | | 3/1995 | Kawahara et al. | |
| 5,533,875 | A | | 7/1996 | Crum et al. | |
| 5,616,973 | A | * | 4/1997 | Khazanov et al. | 310/54 |
| 5,772,411 | A | | 6/1998 | Crum et al. | |
| 5,938,389 | A | | 8/1999 | Shore et al. | |
| 5,997,261 | A | * | 12/1999 | Kershaw et al. | 417/366 |
| 6,000,917 | A | | 12/1999 | Smerud et al. | |
| 6,017,204 | A | | 1/2000 | Holzapfel et al. | |
| 6,068,459 | A | | 5/2000 | Clarke et al. | |
| 6,074,141 | A | | 6/2000 | Ishikawa et al. | |
| 6,074,185 | A | | 6/2000 | Protos | |
| 6,132,183 | A | | 10/2000 | Li et al. | |
| 6,146,113 | A | | 11/2000 | Fassnacht et al. | |
| 6,175,173 | B1 | * | 1/2001 | Stephan et al. | 310/87 |
| 6,191,511 | B1 | * | 2/2001 | Zysset | 310/60 A |
| 6,300,693 | B1 | * | 10/2001 | Poag et al. | 310/54 |
| 6,322,332 | B1 | * | 11/2001 | Jensen et al. | 417/372 |
| 6,398,530 | B1 | | 6/2002 | Hasemann | |
| 6,814,551 | B2 | | 11/2004 | Kammhoff et al. | |
| 6,871,512 | B2 | | 3/2005 | Tsunoda | |
| 7,005,765 | B1 | | 2/2006 | Schulz et al. | |
| 7,063,519 | B2 | | 6/2006 | Agrawal et al. | |
| 7,182,583 | B2 | | 2/2007 | Gandrud et al. | |
| 7,591,147 | B2 | | 9/2009 | Masoudipour et al. | |
| 8,147,216 | B2 | | 4/2012 | Schiffhauer et al. | |
| 2003/0031570 | A1 | | 2/2003 | Kammhoff et al. | |
| 2005/0175479 | A1 | | 8/2005 | Gandrud et al. | |
| 2010/0047091 | A1 | | 2/2010 | Schiffhauer et al. | |

FOREIGN PATENT DOCUMENTS

| | | | | | |
|---|---|---|---|---|---|
| DE | 29 20 883 | | | 12/1980 | |
| DE | 81 11 792 | | | 8/1981 | |
| DE | 30 17 117 | | | 11/1981 | |
| DE | 35 34 665 | | | 7/1987 | |
| DE | 85 36 175 | | | 7/1987 | |
| DE | 36 03 423 | | | 8/1987 | |
| DE | 37 38 592 | | | 5/1989 | |
| DE | 38 17 641 | | | 11/1989 | |
| DE | 41 05 349 | | | 8/1992 | |
| DE | 94 17 662 | | | 2/1995 | |
| DE | 196 04 447 | | | 2/1997 | |
| DE | 196 52 706 | | | 6/1997 | |
| DE | 197 16 758 | | | 10/1998 | |
| DE | 199 10 460 | | | 9/2000 | |
| DE | 102 47 310 | | | 4/2004 | |
| DE | 103 05 812 | | | 9/2004 | |
| DE | 103 07 813 | | | 9/2004 | |
| DE | 10 2005 046 120 | | | 3/2007 | |
| DE | 10 2007 009 394 | | | 8/2008 | |
| DE | 102007009394 | A1 | * | 8/2008 | F04B 17/03 |
| EP | 0 177 925 | | | 4/1986 | |
| EP | 0 314 607 | | | 5/1989 | |
| EP | 0 627 558 | | | 12/1994 | |
| EP | 0 735 270 | | | 10/1996 | |
| EP | 0 819 852 | | | 1/1998 | |
| EP | 0718957 | | | 2/1998 | |
| FR | 2 473 912 | | | 7/1981 | |
| FR | 2 504 206 | | | 10/1982 | |
| JP | 51-31103 | | | 8/1949 | |
| JP | 61-9566 | | | 1/1986 | |
| JP | 61-110877 | | | 7/1986 | |
| JP | 63257434 | | | 10/1988 | |
| JP | 213135 | | | 1/1990 | |
| JP | 387836 | | | 9/1991 | |
| JP | 06016186 | | | 1/1994 | |
| JP | 09-014199 | | | 1/1997 | |
| JP | 10-009135 | | | 1/1998 | |
| JP | 10317964 | | | 12/1998 | |
| JP | 11022482 | | | 1/1999 | |
| JP | 11062607 | | | 3/1999 | |
| JP | 11270885 | | | 10/1999 | |
| JP | 2000130800 | | | 5/2000 | |
| JP | 2003193837 | | | 7/2003 | |
| JP | 2003-232280 | | | 8/2003 | |
| JP | 2005306153 | | | 11/2005 | |
| JP | 2006291744 | | | 10/2006 | |
| JP | 2007-002713 | | | 1/2007 | |
| JP | 2008039251 | | | 2/2008 | |
| WO | 02/23699 | | | 3/2002 | |
| WO | 2008101594 | | | 8/2008 | |

OTHER PUBLICATIONS

Patent Abstracts of Japan, Abstract of Japan Patent "Scroll Type Hydraulic Unit", Publication No. 02196182, Aug. 2, 1990, Japanese Application No. 01015979, Filed Jan. 24, 1989.

Patent Abstracts of Japan, Abstract of Japanese Patent "Scroll Compressor", Publication No. 10220382, Aug. 18, 1998, Japanese Application No. 09022829, Filed Feb. 5, 1997.

* cited by examiner

MOTOR PUMP UNIT

This application is a continuation of international application number PCT/EP2009/001027 filed on Feb. 13, 2009.

The present disclosure relates to the subject matter disclosed in international application number PCT/EP2009/001027 filed on Feb. 13, 2009, which is incorporated herein by reference in its entirety and for all purposes.

BACKGROUND OF THE INVENTION

The invention relates to a motor pump unit for a high-pressure cleaning apparatus having a liquid-cooled electric motor and a pump, wherein the electric motor has a motor housing that is surrounded by a cylindrical shell shaped cooling housing with an annular space having an annular space inlet and an annular space outlet formed therebetween, and wherein the pump has a suction inlet connected to the annular space outlet for drawing in liquid and a pressure outlet for discharging liquid, and wherein the liquid to be transported by the pump can be supplied to the annular space inlet and wherein the cooling housing, on its inside, comprises at least one flow guide rib for guiding the liquid within the annular space.

Motor pump units of this type are known from DE 10 2007 009 394 A1. They are used in high-pressure cleaning apparatuses in which a liquid, preferably water, can be pressurized and then discharged via the pressure outlet. The pressure outlet can have connected to it a high-pressure hose with, for example, a spray lance at its free end. This provides the possibility of directing a high-pressure liquid jet towards an object in order, for example, to clean the object.

The pump is driven by means of an electric motor which is cooled by the liquid that is supplied to the pump. To this end, the motor housing is surrounded by a cylindrical shell shaped cooling housing, wherein an annular space is formed between the motor housing and the cooling housing that can be supplied, via an annular space inlet, with liquid to be transported by the pump. The liquid can flow through the annular space and reach the suction inlet of the pump by way of the annular space outlet, so that it can then be pressurized. Flow guide elements in the form of flow guide ribs which are arranged on the inside of the cooling housing guide the liquid through the annular space. In the motor pump unit as described in DE 10 2007 009 394 A1, the flow guide ribs are configured as supporting ribs by means of which the cooling housing is supported on the motor housing.

In many instances, the pump is connected to the public water supply network. As a result, the delivery pressure of several bars, for example 5 to 10 bar, that exists within the water supply network also exists within the annular space. The operability of the motor pump unit requires the annular space to be reliably sealed; in particular it is to be ensured that the motor housing is also impermeable to water on a long-term basis.

SUMMARY OF THE INVENTION

In accordance with an embodiment of the invention a motor pump unit is provided in which no liquid can leak out of the annular space even in the long term.

In accordance with an embodiment of the invention, the motor pump unit comprises at least one flow guide rib that is spaced-apart from the motor housing.

During operation, the motor housing is exposed to unavoidable vibrations. Vibration exposure may cause relative movement between the cooling housing's flow guide ribs and the motor housing. Where the flow guide ribs are in direct contact with the motor housing, the flow guide ribs may damage the surface of the motor housing by rubbing against or scratching it. This may impair the surface structure of the motor housing and this in turn may cause liquid to leak out of the annular space, through the damaged motor housing and then into the interior of the electric motor. In order to counteract such an impairment of the water impermeability of the motor housing, the invention provides for the flow guide ribs to be positioned at a distance from the motor housing, i.e. for a gap to extend between the flow guide ribs and the motor housing. Surprisingly, it has been shown that despite the spacing between the motor housing and the flow guide ribs, the liquid can, for the most part, be passed through the annular space in a defined direction. Most of the liquid flows along the flow guide ribs, the liquid flow taking a defined direction within the annular space. Only a small portion of the liquid flows obliquely or transversely to the flow guide ribs through the gap between the flow guide ribs and the motor housing. Providing a gap between the flow guide ribs and the motor housing thus ensures that the motor housing remains permanently impermeable to water while the liquid for cooling the electric motor can still be reliably passed through the annular space.

It is advantageous for a flow guide rib to be arranged between the annular space inlet and the annular space outlet. This ensures that liquid entering the annular space via the annular space inlet cannot reach the annular space outlet directly; instead, most of the liquid, starting from the annular space inlet, flows past the entire motor housing and only then reaches the annular space outlet.

It may, for example, be provided for the cooling housing to have a plurality of flow guide ribs which are arranged in a circumferentially offset relation to one another, each comprising a through-passage, wherein the through-passages of adjacent flow guide ribs are arranged in an axially offset relation to one another. With such a configuration, the flow guide ribs as a whole define a labyrinth-like flow path leading around the motor housing in a circumferential direction from the annular space inlet to the annular space outlet. This results in particularly effective cooling of the electric motor.

The height of the gap between the at least one flow guide rib and the motor housing preferably amounts to at least 0.3 mm. In particular, it has proven advantageous to use a height of 0.5 mm and more. For example, it may be provided for the height of the gap between the at least one flow guide rib and the motor housing to be at least 1 mm.

The height of the flow guide ribs is preferably at least 1 mm. It may, for example, be provided for the flow guide ribs to have a height of at least 2 mm. In an advantageous embodiment, it is provided for the height to be at least 3 mm.

It is advantageous for the height of the flow guide ribs to be a multiple of the height of the gap.

In order to enhance the water impermeability of the motor housing, an advantageous embodiment provides for the motor housing to have a corrosion-protective layer. For example, the motor housing may be coated with a special protective material. However, it may also be provided for the corrosion-protective layer to be configured as an oxidation layer of the motor housing.

The motor housing may preferably be made of a deep-drawing steel which is superficially oxidized.

The cooling housing is preferably made of a plastics material. As a rule, plastics housings are prone to vibrations. Therefore, especially with plastics housings, it is particularly advantageous for the at least one flow guide rib to be positioned at a distance from the motor housing in order to avoid damaging its surface.

It is advantageous for the cylindrical shell shaped cooling housing to be adapted to be slid onto the motor housing in an axial direction. This simplifies assembly of the motor pump unit.

In order to prevent liquid from leaking out of the annular space in an axial direction, the annular spacep—in a particularly preferred embodiment—is sealed by means of a front and a rear sealing ring which are clamped in a radial direction between the motor housing and the cooling housing. Sealing of the annular space in the area of the sealing rings is thus realized by radial biasing of the sealing rings. This also results in simplifying assembly of the motor pump unit because the sealing action is ensured by the radial biasing of the O-rings alone; the O-rings need not be clamped in an axial direction.

In an advantageous embodiment, the motor housing, on the side facing towards the pump, has an outward-projecting annular flange which is followed by an annular sealing face contacted by the front sealing ring. The outward-projecting annular flange of the motor housing may be clamped between a bearing shield formed by a drive housing of the pump and a face end of the cooling housing. The front sealing ring, which is clamped in a radial direction between an annular sealing face of the motor housing following the annular flange and a corresponding annular sealing face of the cooling housing, may be positioned on the rear side of the outward-projecting annular flange, which faces away from the pump.

To seal the annular space in its rear area, facing away from the pump, it is advantageous for the motor housing, on the side facing away from the pump, to have a cylindrical shell shaped collar which is surrounded by a cylindrical shell shaped projection of the cooling housing with the rear sealing ring interposed therebetween. The cylindrical shell shaped collar of the cup-shaped motor housing may extend between the bottom and the shell of the motor housing. A cylindrical shell shaped projection of the cooling housing may be aligned concentrically with the cylindrical shell shaped collar of the motor housing, and the rear sealing ring may be clamped in a radial direction between the collar and the projection.

The following description of a preferred embodiment of the invention, taken in conjunction with the drawings, serves to explain the invention in greater detail.

DETAILED DESCRIPTION OF THE INVENTION

Figure 1:
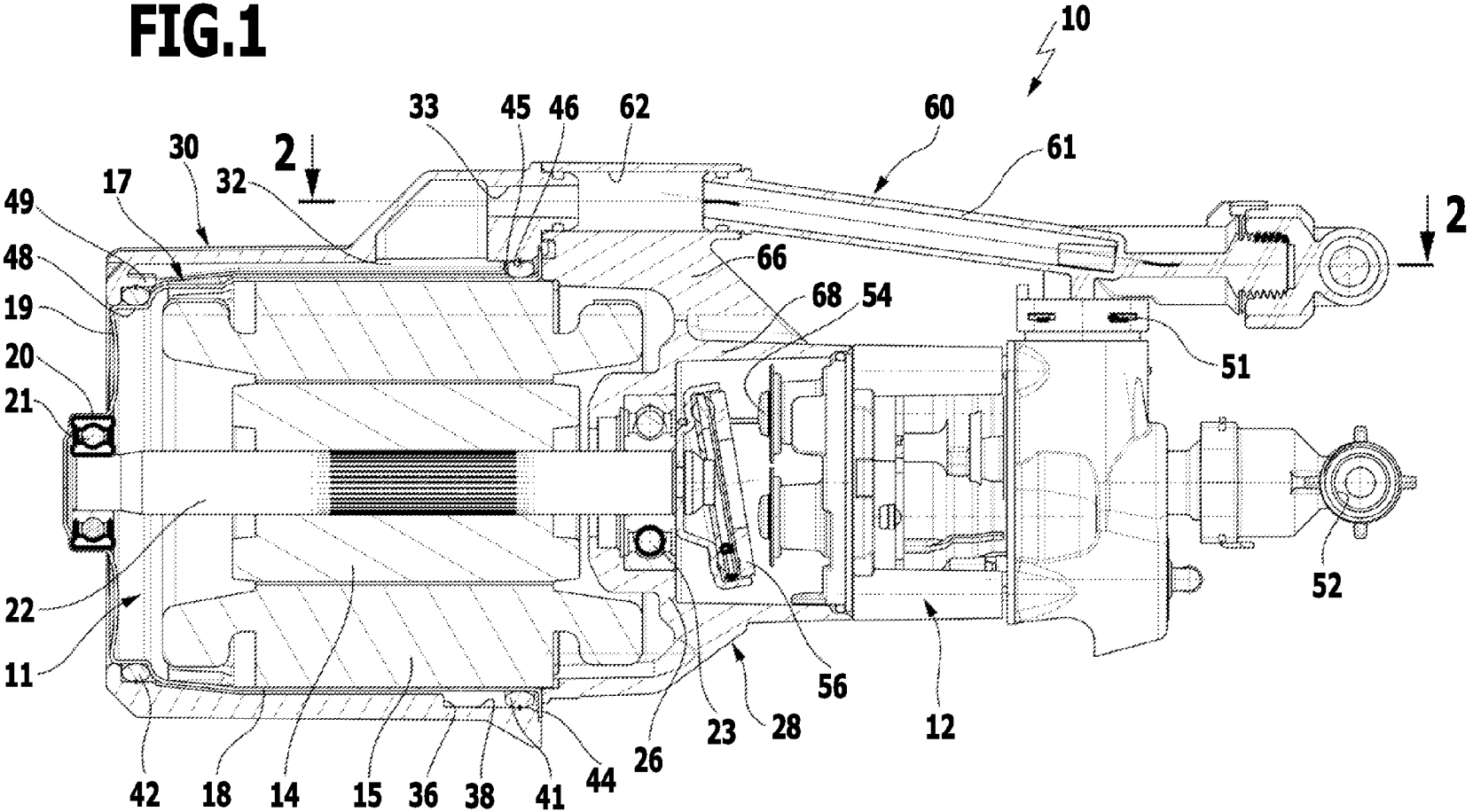
FIG. 1: is a partial sectional view, taken along line 1-1 in FIG. 3, of a motor pump unit.

The drawing is a schematic view illustrating a motor pump unit 10 in accordance with the invention having a liquid-cooled electric motor 11 and a pump 12. The electric motor 11 has, in a conventional manner, a rotor 14 surrounded by a stator 15. On its outside, the stator 15 is followed by a cup-shaped motor housing 17 which is made of a deep-drawing steel. It has a cylindrical shell shaped circumferential wall 18 and a bottom 19. The bottom 19 has a receiving portion 20 directed axially outward for a first bearing 21 of a motor shaft 22. A second bearing 23 of the motor shaft 22 is arranged at a bearing shield 26 which is formed by a drive housing 28 of the pump 12.

The motor housing 17 is surrounded in a circumferential direction by a cylindrical shell shaped cooling housing 30, wherein an annular space 32 is arranged between the motor housing 17 and the cooling housing 30, said annular space completely surrounding the motor housing 17 in the circumferential direction. Via an annular space inlet 33 of the cooling housing 30, the annular space 32 can be supplied with liquid which then flows through the annular space 32. The liquid can flow out of the annular space 32 via an annular space outlet 34 of the cooling housing 30.

On its inside, the cooling housing 30 has a plurality of flow guide ribs 36 which are arranged at a uniform distance from one another in a circumferential direction and protrude radially into the annular space 32, but without contacting the motor housing 17; instead, a gap 37 of about 1 mm in height extends between each flow guide rib 36 and the motor housing 17. The height of the flow guide ribs 36 in a radial direction amounts to at least 2 mm. This is because it is advantageous for the height of the flow guide ribs 36 to be at least twice the height of the gap 37. It is particularly advantageous for the height of the flow guide ribs 36 in a radial direction to be a multiple of the height of the gap 37. For example, the flow guide ribs 36 may have a minimum height of 3 mm and the gap 37 may have a maximum height of 1 mm.

Each of the guide ribs 36 has a through-passage 38 through which liquid supplied to the annular space 32 can flow. The through-passages 38 of adjacent flow guide ribs 36 are arranged in an axially offset relation to one another, the flow guide ribs 36 defining a labyrinth-like flow path leading around the motor housing 17 in a circumferential direction from the annular space inlet 33 to the annular space outlet 34.

In an axial direction, the annular space 32 is sealed by a front sealing ring 41 and a rear sealing ring 42. The front sealing ring 41 is arranged on the side of an outward-protruding annular flange 44 of the motor housing 17 facing away from the pump 12, said flange being clamped between the bearing shield 26 and the face end of the cooling housing 30 facing towards the pump 12.

Sealing of the annular space 32 in the area of the front sealing ring 41 is realized by radial biasing of the sealing ring 41. The latter is clamped in a radial direction between an annular sealing face 45 of the motor housing 17 and a corresponding annular sealing face 46 of the cooling housing 30.

The rear sealing ring 42 contacts a cylindrical shell shaped collar 48 of the motor housing 17 which extends concentrically with the motor shaft 22 in the transition area between the bottom 19 and the circumferential wall 18. The collar 48 is surrounded by a cylindrical shell shaped projection 49 of the cooling housing 30 which is aligned concentrically with the collar 48. The rear sealing ring 42 is clamped in a radial direction between the collar 48 and the projection 49. In an axial direction, it is supported by a radially inward directed recess of the cooling housing 30.

The motor housing 17, as has been noted before, is made of a deep-drawing steel. The latter has a superficial oxidation layer which acts as a corrosion protective layer and ensures that the motor housing 17 is permanently impermeable to water. With the flow guide ribs 36 positioned at a distance from the motor housing 17, it is ensured that the superficial oxidation layer of the motor housing 17 is not impaired by vibrations of the motor housing 17, which could result in damage to the surface of the motor housing 17 if the flow guide ribs 36 were allowed to contact the surface of the motor housing 17.

The pump 12 has, in a conventional manner, a suction inlet 51 and a pressure outlet 52. Pistons 54 of the pump 12 aligned parallel to the motor shaft 22 contact a swash plate 56 which is arranged in the drive housing 28, adjacent to the bearing shield 26 and coupled to the motor shaft 22. For the sake of clarity, the drawing shows the pistons 54 as being arranged at a distance from the swash plate 56. In fact, they contact the swash plate 56 at a face end thereof and are thereby driven for reciprocating movement. In each case, the ends of the pistons 54 facing away from the swash plate 56 extend into a pump space in a conventional manner, so that liquid can be drawn from the suction inlet 51 into the pump space and can be discharged under pressure via the pressure outlet 52.

Figure 2:
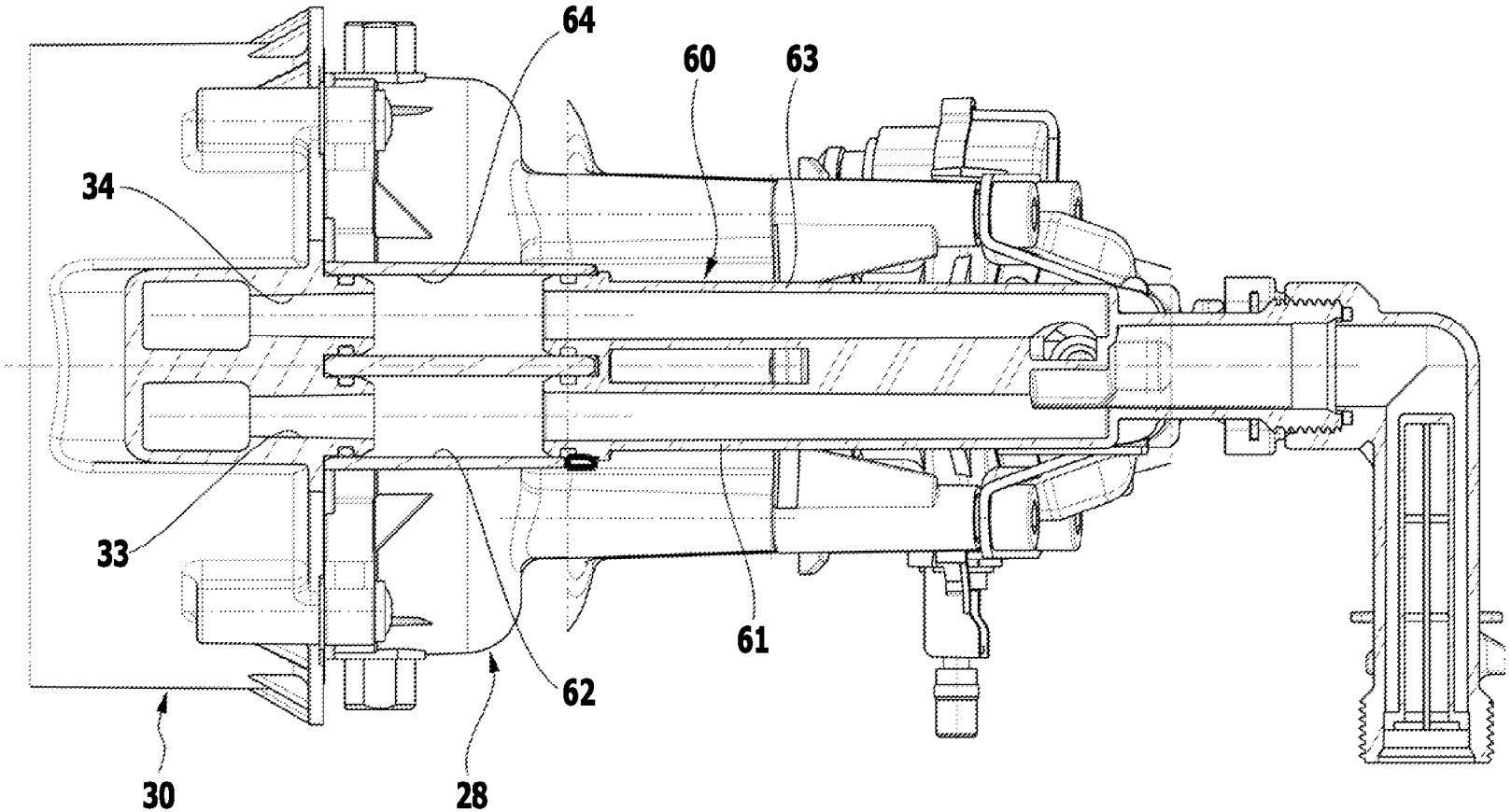
FIG. 2: is a sectional view, taken along line 2-2 in FIG. 1, of the motor pump unit.
Figure 3:
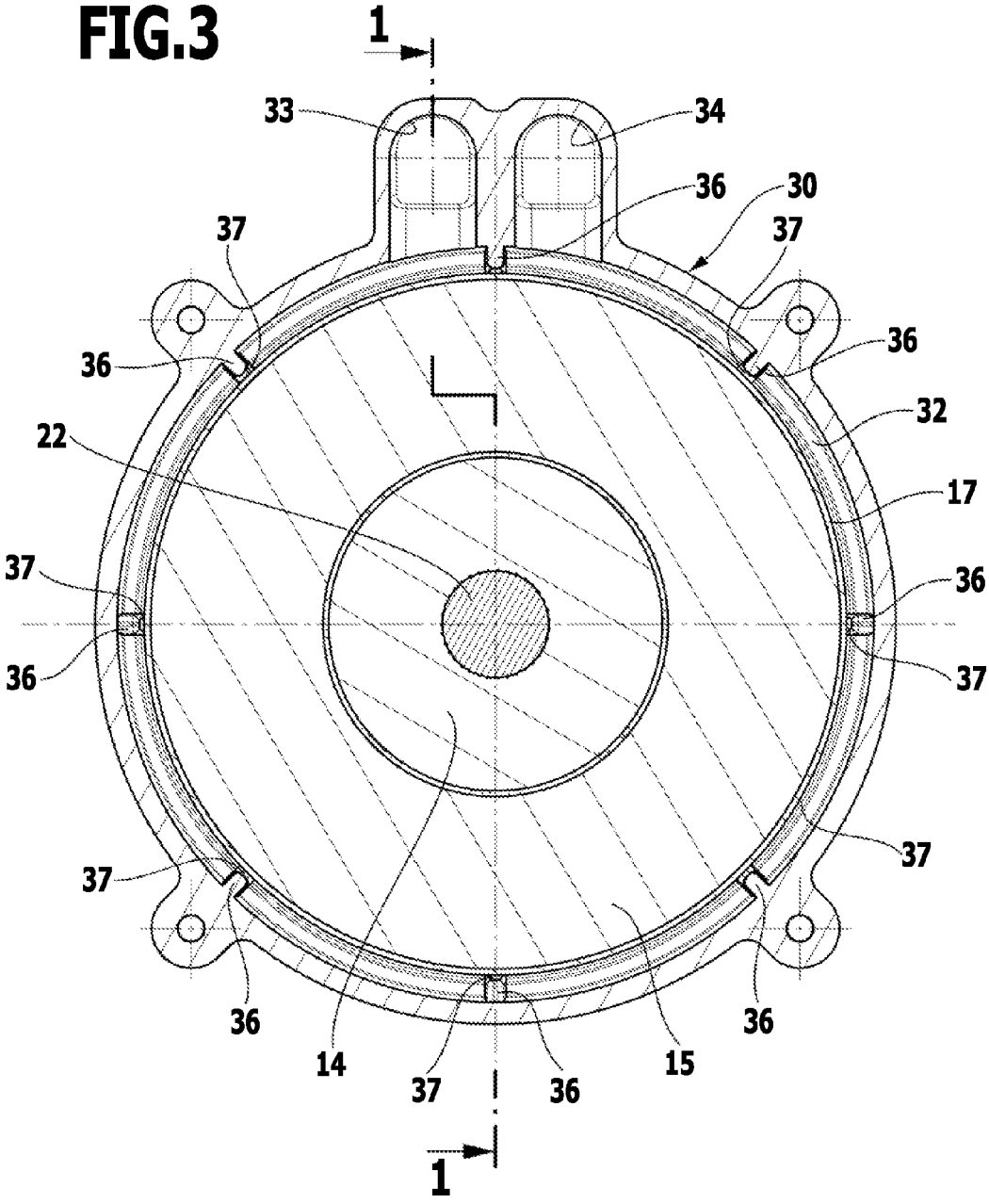
FIG. 3: is a sectional view of the motor pump unit in the area of an electric motor in a direction transverse to the longitudinal axis of the motor pump unit.

Liquid is fed to the pump 12 via a conduit arrangement 60. This is shown in particular in FIG. 2. The conduit arrangement 60 comprises a feed conduit 61 which is connected to a first cooling passage 62 of the drive housing 28 which, in turn, is connected in a liquid-tight manner to the annular space inlet 33. The conduit arrangement 60 further has a connecting conduit 63 which is aligned parallel to the feed conduit 61 and connects to the suction inlet 51 a second cooling passage 64 of the drive housing 28 which is aligned parallel to the first cooling passage 62. The second cooling passage 64 is connected to the annular space outlet 34 in a liquid-tight manner. Starting from the feed conduit 61, liquid to be transported by the pump can thus first flow through the first cooling passage 62 and then through the annular space 32, after which it reaches the suction inlet 51 via the connecting conduit 63, so that it can be pressurized by the pump 12 and discharged via the pressure outlet 52.

The two cooling passages 62 and 64 are connected in one piece to a base body 68 of the drive housing 28 via heat-conductive ribs 66. The base body 68 surrounds the swash plate 56 and also forms the bearing shield 26. The drive housing 28 is made of metal, preferably an aluminium alloy. By providing the cooling passages 62 and 64, it is possible to cool the electric motor 11 and the drive housing 28 alike by the liquid to be transported. This extends the service life of the motor pump unit 10, in particular ensuring that the second bearing 23, the bearing shield 26 and the swash plate 56 as well as the pistons 54 and a piston guide in which the pistons are mounted for linear displacement are not overheated.

As a whole, the motor pump unit 10 in accordance with the invention is thus distinguished by a long service life. The flow guide ribs 36 arranged at a distance from the motor housing 17 ensure that the liquid, for the most part, passes through the annular space 32 following a labyrinth-like flow path, ensuring very good heat transfer from the motor housing 17 to the liquid. Only a small portion of the liquid flows directly through the gap 37 between the flow guide ribs 36 and the motor housing 17. Waste heat from the electric motor 11 can thus be reliably removed, while also ensuring long-term water impermeability of the motor housing 17. The liquid is also prevented from flowing out of the annular space 32 in an axial direction. This is ensured by providing the radially biased sealing rings 41 and 42. Since, in addition, the liquid to be transported also cools the drive housing 28, the overall thermal load of the motor pump unit 10 can be kept permanently low.

The invention claimed is:

1. Motor pump unit for a high-pressure cleaning apparatus, comprising:

a liquid-cooled electric motor and a pump, wherein:

the electric motor has a motor housing that is surrounded by a cylindrical shell shaped cooling housing with an annular space having an annular space inlet and an annular space outlet formed therebetween, the pump has a suction inlet connected to the annular space outlet for drawing in liquid and a pressure outlet for discharging the liquid, the liquid to be transported by the pump is suppliable to the annular space inlet, the cooling housing, on its inside, comprises at least one flow guide rib for guiding the liquid within the annular space, the at least one flow guide rib is spaced-apart from the motor housing, and a gap exists between the at least one flow guide rib and the motor housing along a total longitudinal length of the at least one flow guide rib.

2. Motor pump unit in accordance with claim 1, wherein:

the at least one flow guide rib comprises a plurality of flow guide ribs; and one of the plurality of flow guide ribs is arranged between the annular space inlet and the annular space outlet.

3. Motor pump unit in accordance with claim 1, wherein the gap has a height of at least 0.3 mm.

4. Motor pump unit in accordance with claim 1, wherein the motor housing has a corrosion-protective layer.

5. Motor pump unit in accordance with claim 4, wherein the corrosion-protective layer is configured as an oxidation layer.

6. Motor pump unit in accordance with claim 1, wherein the annular space is sealed by means of a front and a rear sealing ring which are each clamped in a radial direction between the motor housing and the cooling housing.

7. Motor pump unit in accordance with claim 6, wherein the motor housing, on a side facing towards the pump, has an outward-projecting annular flange which is followed by an annular sealing face contacted by the front sealing ring.

8. Motor pump unit in accordance with claim 6, wherein the motor housing, on a side facing away from the pump, has a cylindrical shell shaped collar which is surrounded by a cylindrical shell shaped projection of the cooling housing with the rear sealing ring interposed therebetween.

* * * * *